US005403183A

United States Patent [19]

Andersson et al.

[11] Patent Number: 5,403,183

[45] Date of Patent: Apr. 4, 1995

[54] DEVICE FOR AUTOMATIC REIGNITION OF AN EXTINGUISHED BURNER FLAME

[76] Inventors: Sven-Erik Andersson, Uddbergagatan 6, Trosa, Sweden, S-619 00; Sven U. Erixon, Vegagatan 5, Kalix, Sweden, S-952 37; Stig H. Färndahl, Runsätravägen 33, Farsta, Sweden, S-123 52

[21] Appl. No.: 98,380

[22] PCT Filed: Dec. 10, 1992

[86] PCT No.: PCT/SE92/00854

§ 371 Date: Sep. 13, 1993

§ 102(e) Date: Sep. 13, 1993

[87] PCT Pub. No.: WO93/12378

PCT Pub. Date: Jun. 24, 1993

[30] Foreign Application Priority Data

Dec. 13, 1991 [SE] Sweden ..... 9103669

[51] Int. Cl.[6] ..... F23N 5/00

[52] U.S. Cl. ..... 431/74; 431/80; 431/27

[58] Field of Search ..... 431/27, 69, 70, 73, 431/74, 80

[56] References Cited

U.S. PATENT DOCUMENTS

| | | | |
|---|---|---|---|
| 4,207,054 | 6/1980 | Sobole | 431/69 |
| 4,260,362 | 4/1981 | Matthews | 431/69 |
| 4,303,385 | 12/1981 | Rudich et al. | 431/70 |

*Primary Examiner*—Carroll B. Dority

[57] ABSTRACT

A device for automatic reignition of an extinguished gas flame in a burner. The burner (10) is connected to a gas source via a security valve (13) operated to its closed position by the action of spring means. By magnetic means the security valve can be kept in its open position under the influence of the EMF generated by a thermocouple (25) heated by the gas flame. An igniter (20,21) is activated by an electronic control arrangement (22) upon the latter detecting changes of a predetermined rate of change in the EMF generated by the thermocouple.

11 Claims, 2 Drawing Sheets

DEVICE FOR AUTOMATIC REIGNITION OF AN EXTINGUISHED BURNER FLAME

BACKGROUND OF THE INVENTION

The present invention pertains to gas-operated burners and, in particular, to a device for automatic reignition of the flame in the case, for some reason, said flame has been extinguished.

In gas-operated refrigerators, preferably in movable installations such as caravans or the like, a burner is connected to a gas source, in the shape of an LPG cylinder, via a security valve. When in its non-actuated state the valve is closed but it can be operated manually to its open position by actuation of a push-button or the like. Accordingly, in order to ignite the burner the valve is operated in the way described and, simultaneously, an igniter is activated for the ignition of the gas streaming out. The push-button is kept pressed until the burner has been lit and the gas has been burning for a short while, in order for heating of a termocouple, positioned adjacent to the burner, to take place and the EMF of said termocouple to increase to the magnitude required for a solenoid, being part of the said valve, to be magnetized to keep the valve open even after the push-button has been released.

In movable installations, in particular, it can happen that the burner flame is blown out causing gas to escape which in unfortunate cases may lead to poisoning of people and animals or to explosions. In such a case the security valve described is activated to stop the gas supply after a short time period which may not exceed 30 seconds. Then, the amount of gas that escapes will not attain dangerous proportions.

Of course, it is a good thing that the security valve is activated when the gas flame has been blown out so that the gas supply be cut off before anything serious has happened. However, if the refrigerator is not supervised the goods stored in the refrigerator are heated gradually and may be destroyed, which is a drawback. Accordingly, devices have been proposed which sense the fact that the flame has been blown out and activates an igniter causing the flame to be reignited. It is important that the igniter be activated as soon as possible after the blowing out of the flame and in any case sufficiently before the lapse of 30 seconds when the security valve causes the gas supply to be cut oil. The EMF of the thermocouple can supply energy sufficient for the security valve to be kept open but the energy is not sufficient for moving the movable valve element of the security valve to its open position and this displacement has to take place by means of the push-button referred to above.

A known device for sensing of a flame being extinguished is based on the establishment of an electric current path between two electrodes disposed in said flame. The current is made possible by carbon particles from the gas appearing in the flame. Such a device is often referred to as ionization detector which gives a warning of extinguished flame by the fact that the absence of the flame breaks the current in the detector. This type of detector, however, has shown to give false indication in certain cases indicating the flame to be burning when in fact the flame has been blown out. This may lead to the same devastating consequences as in the case no security valve has been provided, as described above. The detector is sensitive to deposits and moisture which, under certain conditions, may give false indication. Due to the fact that a caravan is provided with a ventilation duct leading from the space surrounding the burner of the refrigerator and opening in a ventilating grill positioned on the outer wall of the caravan, cleaning agents used during wash of the caravan may enter and form a deposit on the electrodes of the detector which, in a humid environment, may cause creepage currents which cause the false indication referred to.

SUMMARY OF THE INVENTION

The object of the invention is to remedy the drawback indicated and to provide a device for automatic reignition of an extinguished burner flame, said device including a detector of a kind which is not influenced by deposits and moisture but always gives a correct indication of an extinguished flame. The object will be achieved by a device of the kind indicated having the characterizing features indicated in claim 1. Preferred embodiments are the subject matter of the accompanying sub-claims.

BRIEF DESCRIPTION OF THE DRAWINGS

The invention will now be described in detail in connection with an embodiment and with reference to the accompanying drawings, in which.

DETAILED DESCRIPTION OF PREFERRED EMBODIMENTS

Figure 1:
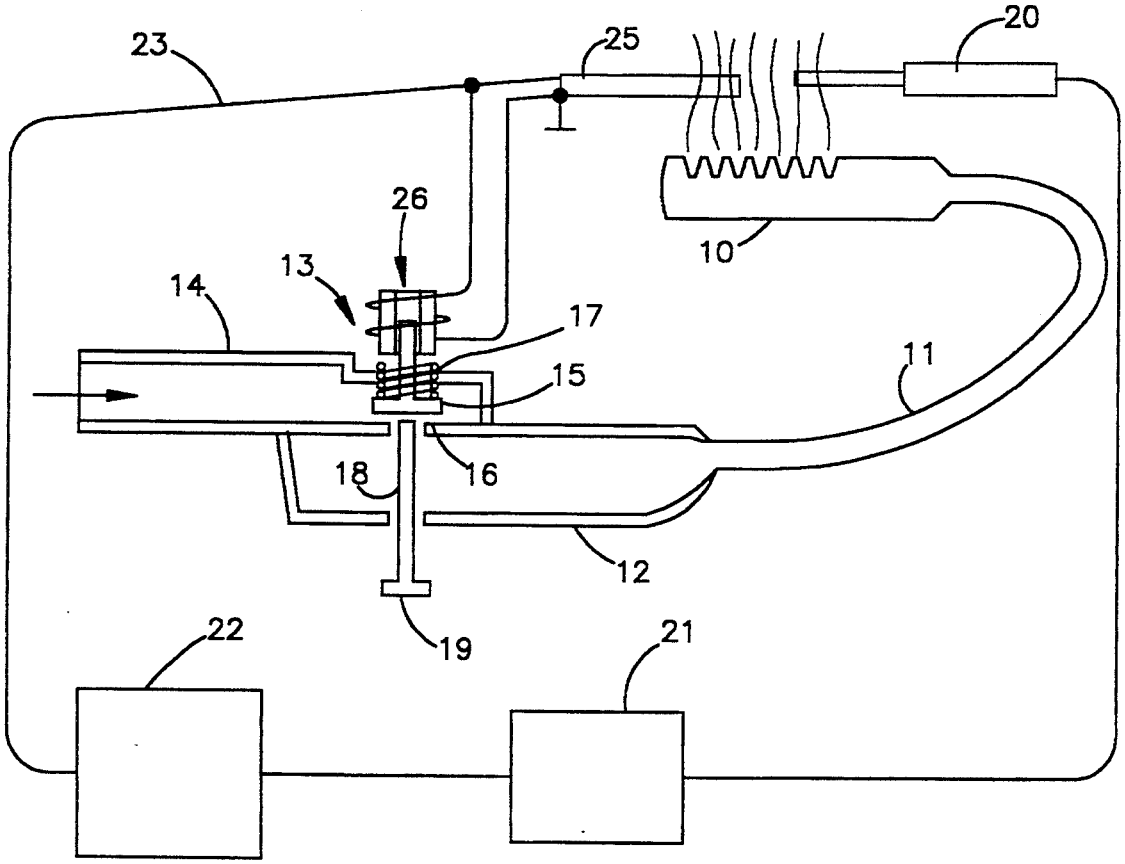
FIG. 1 schematically shows a gas burner, e.g. for a refrigerator, with associated components for the supply of gas and for igniting same.

In FIG. 1 there is shown, schematically, a burner 10 which is connected, via a gas conduit 11, to the outlet 12 of a security valve 13, the inlet 14 of which being connected to a gas source, e.g. a LPG cylinder, not shown. The security valve is of a common type comprising a valve cone 15 sealingly engaging with a seat 16 against which it is pressed by a spring 17. The valve cone can be moved in a direction away from the seat by means of a rod 18 actuated by a push-button 19. Accordingly, by pressing the button against the action of the spring 17 the valve can be operated to its open position.

For the ignition of the burner an igniter is provided which in the embodiment described comprises a spark plug 20 which is electrically connected to a spark generating device 21 controlled by an electronic control arrangement 22. The latter is, via a conductor 23, connected to one terminal of a thermocouple 25 disposed adjacent to the burner to be heated by the burner flame. The other terminal of the thermocouple is connected to a reference potential, here referred to as chassis ground, as are the burner, the gas conduit and the remaining metallic constructive parts. In addition, the thermocouple is connected to a solenoid 26 the movable armature of which is constituted by the valve cone 15. When the thermocouple is heated by the flame and generates an EMF the solenoid keeps the valve cone in a position in which the valve is open. A security valve cooperating in the manner described with a thermocouple for cutting off the gas supply in case of the flame being extinguished is commonly known and used in gas applications like gas-operated refrigerators and gas stoves.

Figure 2:
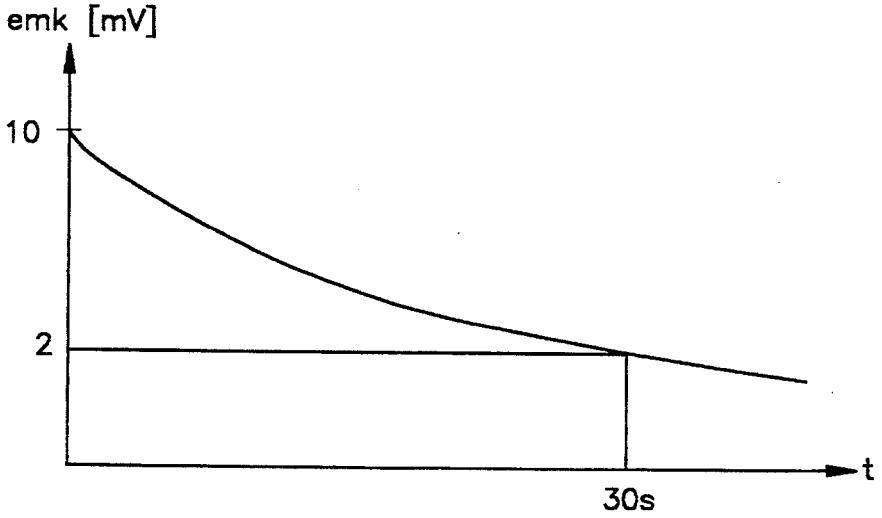
FIG. 2 shows a voltage/time diagram of the EMF of a thermocouple associated with the device of FIG. 1; and, finally.

In FIG. 2 a graph is shown illustrating the thermocouple EMF decreasing in course of time when the burner flame has been extinguished and the thermocouple is no longer heated. In no-load condition the EMF generated can amount to about 30 mV whereas when the thermocouple is loaded by the solenoid the EMF decreases to about 10 mV. The graph is valid for the loaded thermocouple and when the flame is extinguished, in about 30 seconds the voltage decreases to about 2 mV. At this latter level the magnetization of the solenoid will not be sufficient for keeping the valve open and the spring 17 can move the valve cone 15 into engagement with the seat 16 closing the valve.

If now it is to be discovered that the flame has been extinguished out of a study of the thermocouple voltage, the first option is to study the level and to act when the level has dropped to a lower value. To set a fixed level where the igniter is to be activated for reignition of the flame involves uncertainty as the time lapsing from the flame being extinguished and until said fixed level has been reached varies due to the fact that different thermocouples have somewhat different EMF. It is important that the reignition be initiated upon the slightest sign of the flame being extinguished so as not to loose valuable time. Accordingly, to that end it is suggested, in accordance with the invention, to study changes in the voltage of the thermocouple instead and when the rate of change (the slope of the graph) is of a predetermined magnitude this will constitute a criterion of the flame being extinguished and of the igniter to be activated. In this way sparks can be generated shortly after the voltage has started to drop and there will be plenty of time to reignite before the security valve closes and one will be forced to reignite manually by use of the push-button 19. When reigniting manually, the igniter 20, 21 shown in FIG. 1 will be used in the manner to be described more in detail in the following.

Figure 3:
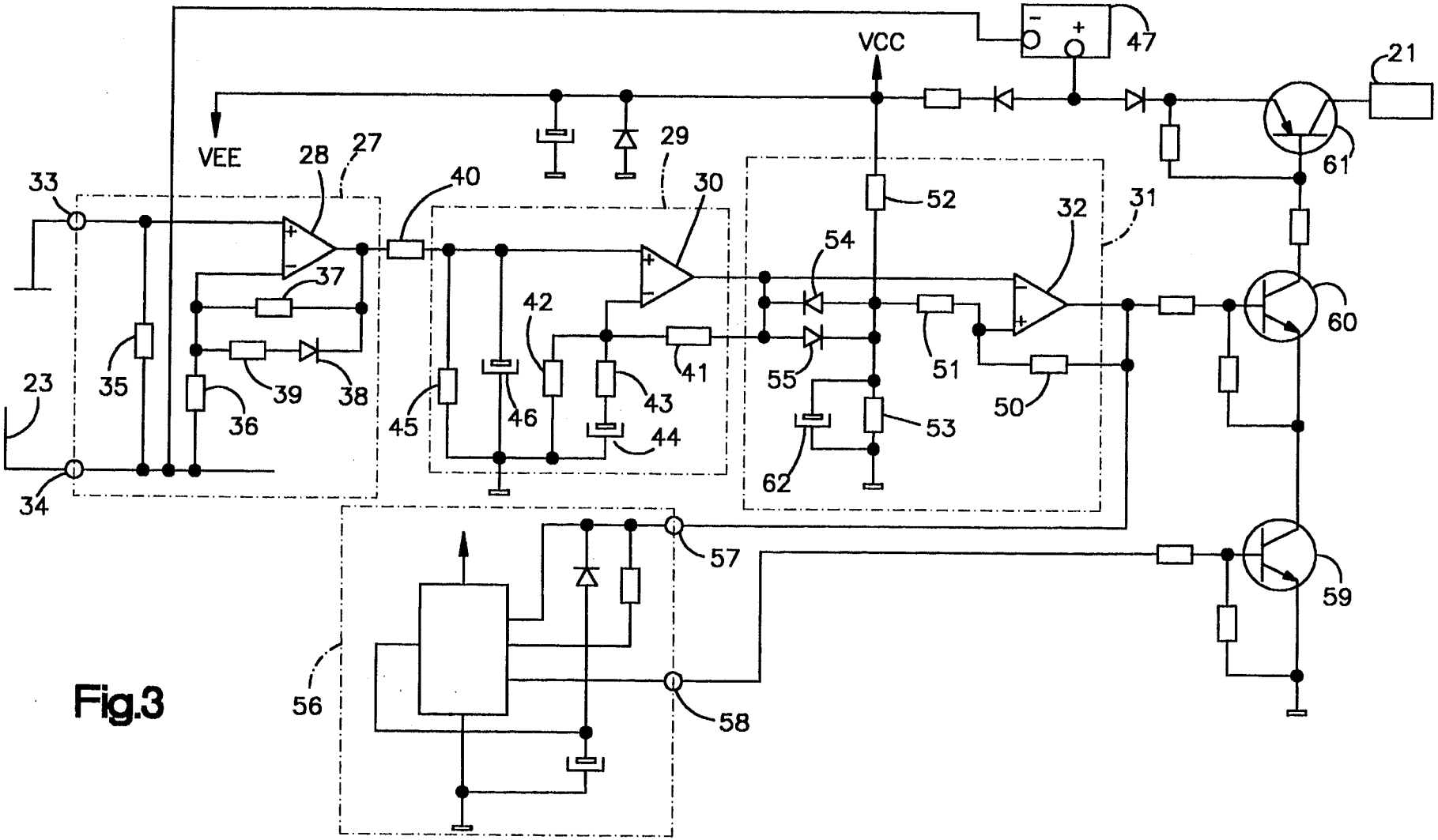
FIG. 3 shows a circuit diagram for an electronic control arrangement being part of the device of FIG. 1.

The continued description will take place in connection with FIG. 3 which shows a circuit diagram for the electronic control arrangement 22 of FIG. 1. The control arrangement comprises an input stage 27 constituted by an operational amplifier (OPAMP) 28. The input stage is connected to an amplifier stage 29 constituted by an OPAMP 30. The latter is connected to a comparator stage 31 constituted by an OPAMP 32. The OPAMPS 28, 30 and 32 are included in a common integrated circuit (IC) and are, in the normal way, provided with a positive input terminal, a negative input terminal and an output terminal. The IC is supplied from a DC source 47 having the voltage 12 V. Positive supply voltages to the IC have been marked VCC and VEE, respectively, in FIG. 3 and these voltages have been provided in the usual way by circuits for rectfication and stabilisation. The corresponding components required have been shown in the figure but will not be discussed in detail. The negative reference potential of the IC is the opposite to the positive voltages VCC and VEE and this reference voltage also appears at an input terminal 34 of the input stage 27 to which the conductor 23 (FIG. 1) is connected. This circuit ground thus differs from the real ground reference potential, referred to as chassis ground, which is present in the remainder of the circuit diagram. The circuit has been designed in the way described in order for the input stage 27 to be able to handle negative signals without the demand for a negative supply voltage to be provided in addition to the positive supply voltage.

The control arrangement needs information about the EMF of the thermocouple and to that end, in addition to the input terminal 34, the input stage 27 is provided with an additional input terminal 33 connected to ground. This terminal is also connected to the positive input terminal of the OPAMP 28. Via resistors 35, 36, the terminal 34 is connected to the positive input terminal and to the negative input terminal, respectively, of the OPAMP. In the common way, the negative input terminal and the output terminal of the OPAMP 28 are interconnected by a resistor 37 which together with the resistor 36 determines the amplification of the input stage. The resistor 37 is connected in parallel with a branch comprising a zener diode 38 connected in series with a resistor 39. This branch has the function of decreasing the amplification in case of high input voltage at the positive input terminal of the OPAMP hence preventing the input stage from being overdriven.

The output terminal of the OPAMP 28 is connected, via a resistor 40, to the positive input of the OPAMP 30. Via a resistor 41, the output terminal of the OPAMP 30 is connected to the negative input terminal of said OPAMP which is connected to ground via a resistor 42. The feedback path formed by the resisters 41 and 42 determines the DC voltage amplification of the stage. Another branch, comprising a resistor 43 connected in series with a capacitor 44, is connected in parallel with the resistor 42. The stage is hereby given a signal amplification which is about 5 times higher than the DC voltage amplification. Finally, the positive input terminal of the OPAMP 30 is connected to ground via a resistor 45 in parallel with a capacitor 46. These components form a filter which suppresses the noise otherwise appearing on the positive input terminal when the igniter is operating and sparks are generated.

The output terminal of the OPAMP 30 is directly connected to the negative input terminal of an OPAMP 32 operating as a comparator. The positive input terminal and the output terminal of the comparator are interconnected by a resistor 50. Further, via a resistor 51, the positive input terminal is connected to the junction between two resisters 52 and 53 which form a voltage divider connected between the voltage VCC and ground. The resistor 53 is connected in parallel with a capacitor 62. As a result, the positive input terminal obtains a reference level to be compared with the voltage on the negative input terminal. The junction between the resisters 52 and 53 is connected to the negative input terminal of the comparator via two diodes 54, 55 connected in antiparallel. As a result, the reference voltage of the comparator can automatically adapt itself to different levels on its negative input terminal, e.g. caused by variations in the EMF of the thermocouple. In serial production, variations in tolerances between different thermocouple copies may give cause to the variations indicated which will thus be compensated so that there will be no need for individual calibration.

When activated the igniter shall be operating as long as the security valve is open in order to bring about reignition of the burner flame during this time period. Said time period amounts to about 30 seconds and when the time has elapsed the igniter shall be disconnected. A timing circuit 56 is provided for determining of said time period. The circuit, which is of the type 555, has an input 57 and an output 58. The input 57 is connected to the output of the comparator 32 while the output 58 is connected to the base circuit of a transistor 59 connected in series with a further transistor 60 having a base circuit to which the output of the comparator is connected as well. The collector circuit of the transistor 60 is connected to the base circuit of a transistor 61 the collector-emitter path of which transfers voltage from the voltage source 47 to the spark generating device 21. The surrounding components, in the form of resistors and the like required for the transistors 59–61 to operate, have been shown in the drawing but will not be discussed in detail.

The control arrangement of FIG. 3 operates as follows:

When the burner is operating, the flame is burning and the thermocouple 25 heated and the resulting EMF of the termocouple appears across the terminals 33 and 34. As a result, the output of the OPAMP 28 has a high level which is true also for the output of the OPAMP 30. Then, the reference voltage for the comparator 32, which emanates from the junction between the resistors 52 and 53, assumes a value which goes below the voltage at said junction by a value corresponding to the voltage drop across the diode 55. This is conditional on the voltage at the output of the OPAMP 30 being higher than the sum of the voltage drop across the diode 55 and the basic voltage level at the junction between the resistors 52 and 53, determined by these resistors and the supply voltage VCC. The negative input of the comparator 32 then assumes a level which is higher than that of its positive input and the output of the comparator assumes a low level. As a result, the transistor 60 is cut-off at the same time as the timing circuit 56 is inactivated and, accordingly, also the transistor 59 cut-off. Hence, the igniter is disconnected.

If, now, the burner flame should be blown out, the thermocouple 25 begins to cool by the gas flow, now cold, and in a few seconds the voltage across the terminals 33 and 34 decreases to such extent that a change can be detected by the control arrangement. The change, which is negative, is amplified in the input stage 27 and further amplified in the stage 29 so that the level at the output of the OPAMP 30 declines rapidly. The time constant for the resistor 53 and associated capacitor 62, connected in parallel, is large resulting in the voltage at the junction between the resistors 52 and 53 to assume a level which exceeds the voltage at the output of the OPAMP 30 by the voltage drop across the diode 54. The positive input of the comparator 32 will thus assume a level which is higher than that at its negative input and the output will switch to a high level. At the same time, the high level at the output of the comparator will trigger the timing circuit 56 the output 58 of which will go high bringing the transistor 59 to conduct. As a result, also transistor 60 starts conducting and the transistors 59 and 60, now both conducting, will activate the transistor 61 so that voltage will be supplied to the spark generating device 21 (FIG. 1). The device 21 repeatedly emits sparks for reignition of the burner flame for a time period determined by the timing circuit 56. At the elapse of the said time period the output 58 of the timing circuit goes low causing the transistor 59 to be cut-off. Then, the condition necessary for the transistor 60 to conduct ceases and also this transistor will be cut-off. As a result, also transistor 61 will be cut-off disconnecting the supply voltage from the spark generating device 21. If reignition of the burner flame has not taken place during the time period determined by the timing circuit 56 it can no longer be reignited automatically and a manual procedure has to be used. The reason for this is that after a time period of about 30 seconds the EMF of the thermocouple has declined to such a low level that the solenoid 26 is no longer able to keep the security valve open. The igniter shown is used also during the manual reignition procedure after the security valve has closed as well as when the burner flame is to be ignited, e.g. when a refrigerator in which the burner is included is to be put into operation. The basic setting, determined by the resistors 52 and 53 and the voltage source VCC, has been chosen so that when the thermocouple is cold and the supply voltage is applied to the control arrangement the positive input of the comparator has a level higher than that at its negative input and, hence, its output assumes a high level causing the igniter to be activated in the way described.

If the ignition is successful and the burner flame lit the thermocouple is heated in the way described causing the output of the comparator 32 to assume a low level which results in the transistor 60 to be cut-off. If the ignition takes place before the elapse of the time period determined by the timing circuit 56 the transistor 59 is still conducting but as the transistor 60 is now cut-off also transistor 61 will be cut-off disconnecting the igniter 21. Accordingly, the igniter will only be in operation until ignition has taken place or the time period determined by the timing circuit 56 has elapsed.

The invention is not restricted to the embodiment described above and shown in the drawings and modifications are possible within the scope of the appending claims.

We claim:

1. In a device for automatic reignition of an extinguished gas flame in a burner, said burner being connected to a gas source via a valve, said device comprising an igniter for igniting the flame when activated, a thermocouple arranged to be heated by the gas flame, and an electronic control arrangement for sensing an EMF of the thermocouple and activating the igniter when changes in said EMF occur at a predetermined rate of change, the improvement comprising said electronic control arrangement including means for automatically adapting to levels of EMF generated by thermocouples of various magnitudes when used in said device so that the igniter is activated in a consistent manner.

2. A device according to claim 1, wherein said valve is a security valve arranged to be operated to a closed position by the action of spring means, said valve being kept in an open position by the action of magnetic means under the influence of the EMF of the thermocouple, said valve further being operable to said open position by a manual operating means.

3. A device according to claim 2, wherein said predetermined rate of change is chosen such that a time period elapsing before activation of the igniter is short compared to a time period elapsing before closure of the valve when the flame has been extinguished.

4. A device according to claim 3, wherein said electronic control arrangement comprises an input stage to which the thermocouple is connected, said input stage being adapted for a negative signal from the thermocouple.

5. A device according to claim 4, wherein said input stage includes an OPAMP to which voltage is supplied via a positive supply terminal and circuit ground, said OPAMP having a positive input and a negative input, and the thermocouple having a not grounded terminal connected to the circuit ground which is connected, via a resister, to the negative input of the OPAMP.

6. A device according to claim 1, wherein said electronic control arrangement comprises a comparator having signal and reference inputs, said signal input being adapted to receive a signal having a magnitude which represents a rate of change of the EMF of the thermocouple and said reference input being adapted to receive a reference signal, said comparator emitting an output signal for activating the igniter when the rate of change has reached said predetermined rate of change.

7. A device according to claim 6, wherein said igniter is activated for a predetermined time period determined by a timing circuit, said predetermined time period essentially corresponding to said time period elapsing before closure of the valve when the flame has been extinguished.

8. A device according to claim 7, wherein said igniter is connected to an activation circuit comprising two transistors connected in series, one of said transistors is controlled by the output signal from the comparator and the other of said transistors is controlled by an output signal from the timing circuit, said output signal from the comparator also operating the timing circuit to emit said output signal from the timing circuit.

9. A device according to any of the claims 6–8, wherein said reference signal to the comparator has a basic level chosen so as to bring the igniter into operation as soon as the supply voltage is applied when the burner flame is to be manually ignited, the thermocouple is cold, and the security valve is closed.

10. A device according to claim 9, wherein said reference voltage to the comparator is generated by a voltage divider comprising two resisters, a junction between the two resistors is connected, via two diodes connected in antiparallel, to the signal input of the comparator and, via a resister, to the reference input of the comparator.

11. In a device for automatic reignition of an extinguished gas flame in a burner, said burner being connected to a gas source via a valve, said device comprising an igniter for igniting the gas flame when activated, a thermocouple arranged to be heated by the gas flame, an electronic control arrangement for sensing an EMF of the thermocouple and activating the igniter when changes in said EMF occur at a predetermined rate of change, the improvement comprising said control arrangement including comparator means for comparing a voltage representing a rate of change of the EMF with a reference voltage and means for adapting a level of the reference voltage to a level of the EMF generated by a thermocouple of a different magnitude of EMF when used in said device so that the igniter is operated in a consistent manner.

* * * * *

UNITED STATES PATENT AND TRADEMARK OFFICE

CERTIFICATE OF CORRECTION

PATENT NO. : 5,403,183

DATED : April 4, 1995

INVENTOR(S) : Andersson et al.

It is certified that error appears in the above-indentified patent and that said Letters Patent is hereby corrected as shown below:

On the title page, item [73], insert --Aktiebolaget Electrolux, Luxbacken 1, S-105 45 Stockholm, Sweden--.

On the title page, under item [56], insert Attorney, Agent or Firm: -- Pearne, Gordon, McCoy & Granger--.

Signed and Sealed this

Twelfth Day of December, 1995

*Attest:*

*Attesting Officer*

Bruce Lehman

BRUCE LEHMAN

*Commissioner of Patents and Trademarks*